US005887352A

United States Patent [19]

Kim

[11] Patent Number: 5,887,352

[45] Date of Patent: Mar. 30, 1999

[54] GUN SIGHT SYSTEM

[76] Inventor: Steve Kim, 1250 University St. #A, Redlands, Calif. 92374

[21] Appl. No.: 915,455

[22] Filed: Aug. 20, 1997

[51] Int. Cl.[6] ..... F41G 21/00

[52] U.S. Cl. ..... 33/233; 33/252

[58] Field of Search ..... 33/233, 241, 252

[56] References Cited

U.S. PATENT DOCUMENTS

| | | | |
|---|---|---|---|
| D. 248,310 | 6/1978 | Hestehave | D22/8 |
| D. 360,454 | 7/1995 | DePaoli | D22/109 |
| 4,102,053 | 7/1978 | Colwell | 33/233 |
| 4,606,131 | 8/1986 | Domian | 33/257 |
| 4,790,075 | 12/1988 | Howard, Sr. | 33/233 |
| 5,065,519 | 11/1991 | Bindon | 33/241 |
| 5,327,654 | 7/1994 | Parker | 33/258 |

*Primary Examiner*—Charles T. Jordan
*Assistant Examiner*—Chris J. Brown
*Attorney, Agent, or Firm*—Goldstein & Canino

[57] ABSTRACT

A gun sight system for accurately directing a bullet of a firearm towards a target, comprising a front sight and a rear sight each having a transparent medium with a geometric shape inscribed upon the transparent medium. By looking through the rear sight towards the front sight and aligning the geometric shapes in a pre-determined manner with the target seen in the background through the transparent mediums, an accurate contact of the bullet with the target is guaranteed upon firing the firearm.

4 Claims, 3 Drawing Sheets

51
58
14
60
62C'
54
16
56
62
52
54
54

51
62C
62C'
14
54
54
16

14
60
62C'

56
16
54
54
12D
64
66
14
62C'
52
54
16
64
66

GUN SIGHT SYSTEM

BACKGROUND OF THE INVENTION

The invention relates to a gun sight system. More particularly, the invention relates to a gun sight employing a front and rear sight, each having a transparent carrier, indicia located therein allowing alignment of the front and rear sight to accurately aim the gun prior to firing.

A firearm only properly accomplishes its purpose when the bullet reaches it's intended target. Getting the bullet in the right place, at the right time is a combination of firearm design, skill of the operator, and superiority of the sighting system. A stray bullet is a wasted bullet, as well as a potentially dangerous bullet. In law enforcement situations, firearms must be fired in uncontrolled circumstances, where an inaccurate bullet can cause damage and injury.

Handguns in particular leave much to be desired in terms of accuracy. They are notorious for missing their targets, especially when improperly used. Their inherent problems lay not only in the size of the barrel, but also in the lack of assistance that conventional sighting systems provide to a user attempting to accurately aim the gun under varying circumstances.

Conventional sighting systems fail to recognize that different circumstances dictate a vastly different sighting system. Shooting a moving target dictates a vastly different sighting task and equipment than required for taking a careful, deliberate shot at a fixed target. A moving target requires a sighting system that allows the shooter to quickly assess and fire upon the target. The fixed target requires a sighting system which may requires more time to align, but which has greater inherent accuracy.

U.S. Pat. No. 4,102,053 to Colwell discloses a removable rifle sight. Colwell is designed to be exchanged with a conventional rifle sight, when fast sighting is desired. However, Colwell requires a complicated, magnetic mechanism to allow the sight to be attached and detached.

U.S. Pat. No. 4,790,075 to Howard, Sr., discloses a portable removable gun sight which is attached onto a rifle when needed. Being a single piece construction, this gun sight does not provide any remote complementary structure with which to align the sight. Thus, the device of Howard, Sr. has considerable built-in inaccuracy.

U.S. Pat. No. 5,327,654 to Parker discloses a gun sight which employs a rear sight having a rectangular channel, and a front sight having a barrel shape. The sight is used by aligning the barrel with the channel. Parker provides no provisions for adapting to varying sighting purposes.

U.S. Pat. No. 4,606,131 to Domian discloses an interchangeable gun sight, which allows the sight blade to be interchanged for one having a different width slit for differing sighting purposes.

While these units may be suitable for the particular purpose employed, or for general use, they would not be as suitable for the purposes of the present invention as disclosed hereafter.

SUMMARY OF THE INVENTION

It is an object of the invention to produce a gun sight system which allows greater accuracy than prior art gun sight systems.

It is another object of the invention to produce a gun sight system which is adaptable for different applications, different configurations are useful for accomplishing different sighting purposes.

It is yet another object of the invention to employ a front and rear sight, each having a transparent medium. Indicia is located within the transparent medium to effectuate alignment of the sights with each other, and the gun with the target.

It is a further object of the invention, that different indicia configurations are used to accomplish the different sighting purposes.

It is a still further object that the different indicia configurations are located on interchangeable transparent mediums, which may be quickly and easily interchanged in the field when a different sighting purpose is encountered or anticipated.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
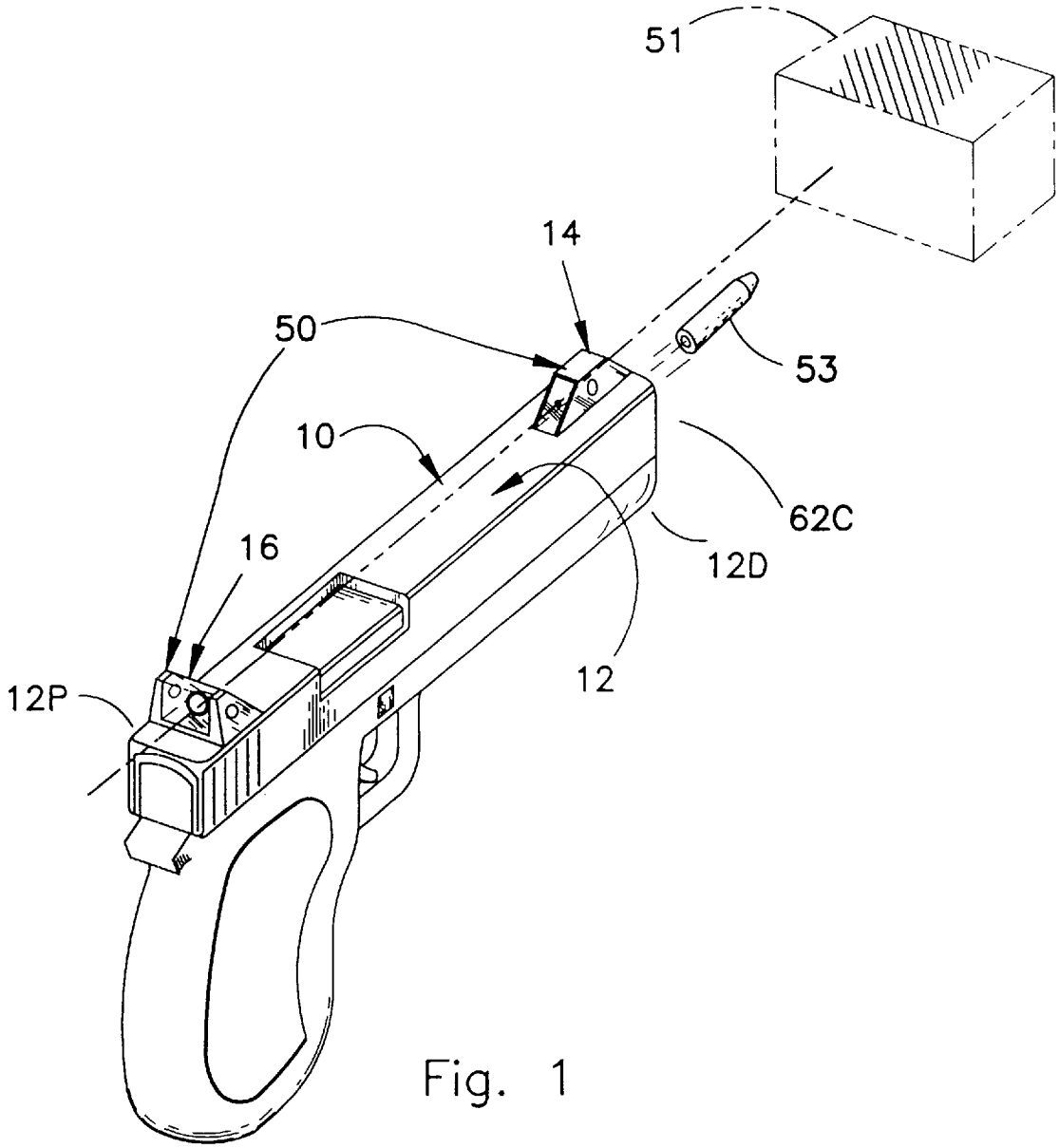
FIG. 1 is a diagrammatic perspective view of a firearm with the gun sight system of the instant invention installed thereupon.

Certain terminology is used in the following description for convenience only and is not limiting. The words "right," "left," "lower" and "upper" designate directions in the drawings to which reference is made. The words "proximal end" and "distal end" refer, respectively, to ends of an object nearer to and further from the operator of the object when the object is used in a normal fashion or as is described in the specification.

FIG. 1 illustrates a firearm 10 having a gun sight system 50 of the instant invention installed thereupon. The firearm 10 comprises a slide/barrel assembly 12 which extends along the upper length of the firearm 10. The slide/barrel assembly 12 further has a proximal end 12P and a distal end 1D. Typically, the firearm 10 is sighted prior to firing by a user simply looking down along the length of the slide/barrel assembly 12 and aligning a "sight" which merely comprises an object protruding upward (not shown) from the slide/barrel assembly, with a target 51. Inaccurate shots typically result, especially when the desired target 51 is a moving object.

Figures 2A, 2B, 3A, 3B:
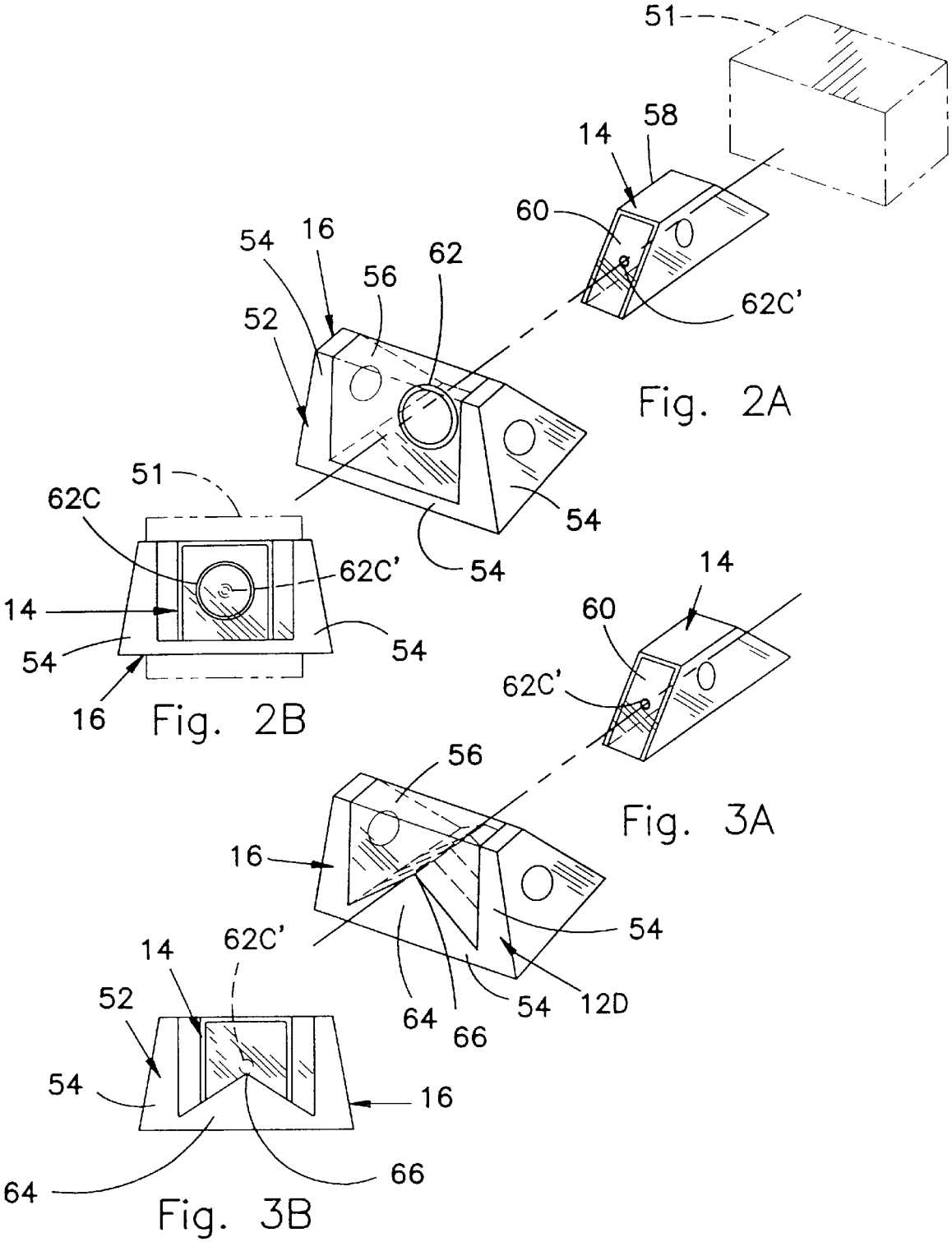
FIG. 2*a* illustrates a line of sight through a first embodiment of the gun sight system, the gun sight system comprising a front barrel sight and a rear sight.
FIG. 2*b* depicts proper direct alignment of the front barrel sight behind the rear sight of the first embodiment of the instant invention.
FIG. 3*a* illustrates a line of sight through a second embodiment of the gun sight system.
FIG. 3*b* depicts proper direct alignment of the front barrel sight behind the rear sight of the second embodiment of the instant invention.

Referring to FIGS. 1 and 2*a*, it is seen that the gun sight system 50 of a first embodiment of the instant invention contemplates employing a front barrel sight 14 installed upon the distal end 1D of the slide/barrel assembly 12, and a rear sight 16 installed at the proximal end 12P thereof, as is seen in FIG. 1. The rear sight 16 of each embodiment of the gun sight system 50 comprises a base assembly 52 having a plurality of side walls 54. A rear transparent medium 56 is removeably affixed and contained within said plurality of base side walls 54. The front barrel sight 14 comprises a tent-shaped housing 58 having a front transparent medium 60 removeably encapsulated therein. The rear transparent medium 56 and the front transparent medium 60 both have indicia 62 inscribed therein which, when aligned, direct the slide/barrel assembly 12 precisely at the intended target 51, thus ensuring that a bullet 53 fired therefrom will directly acquire said target 51. Of course, it is often necessary for the manufacturer or installer of the system to test and calibrate the system initially to ensure that all fired bullets 53 will be fired true and correctly acquire their target upon proper alignment of the front barrel sight 14 and rear sight 16. The effectuation of such proper alignment will be discussed at greater length at a later point.

It is further contemplated in the first preferred embodiment of the instant invention that the indicia 62 located upon the front transparent medium 60 be distinct in appearance from the indicia 62 located upon the rear transparent medium 56 in order to assist in proper alignment thereof. Furthermore, because the indicia 62 inscribed upon the rear transparent medium 56 and front transparent medium 60 appears to be "floating" due to the transparent nature of said mediums, the indicia appears to be "painted" upon the intended target 51 when said target 51 is viewed through the aligned front barrel sight 14 and rear sight 16, as seen in FIG. 2*b*. In addition, the plurality of sides 54 of the rear sight 16 serve to "frame" the target 51 to further assists in proper alignment.

In the first preferred embodiment of the gun sight system 50, the rear transparent medium 56 of the rear sight 16 has a geometric shape such as a circle 62C inscribed thereupon, while the front transparent medium 60 of the front barrel sight 14 has a geometric shape such as a circle 62C' of a different diameter inscribed thereupon. FIG. 2*b* illustrates a view through the front barrel sight 14 and rear sight 16 after proper alignment upon the target 51. As seen, the circle 62C of the rear sight 16 is larger than and encircles the smaller circle 62C' of the front barrel sight 14. It should also be understood that the circle 62C' of the front barrel sight 14 can be larger than the circle 62C of the rear sight 16, and hence said circle 62C' of the front barrel sight 14 be caused to encircle the smaller circle 62C of the rear sight 16 when viewed from the proximal end 12P of the firearm 10 in order to effectuate proper alignment to accurately strike the target 51 with the bullet 53.

Figure 4A:
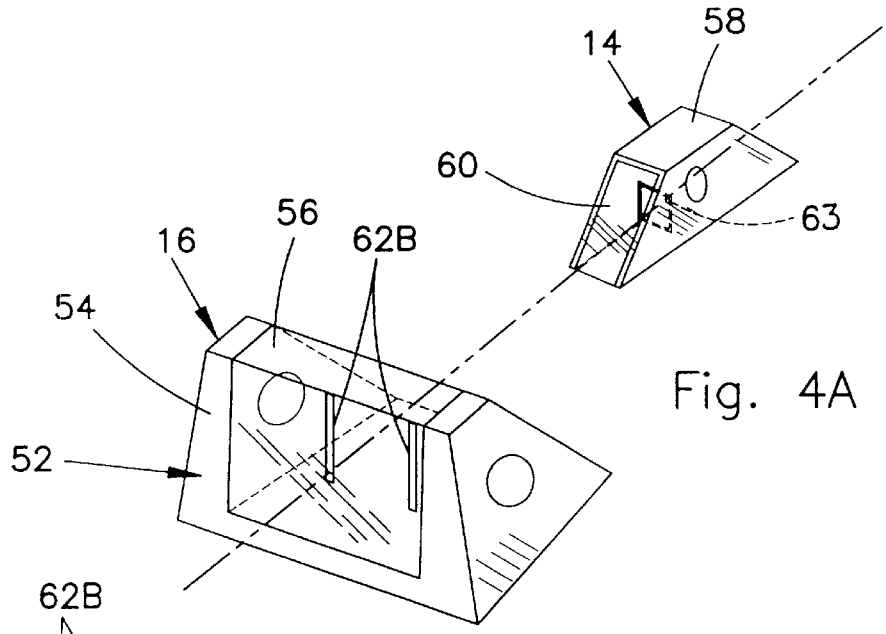
FIG. 4*a* illustrates a line of sight through a third embodiment of the gun sight system.
Figure 4B:
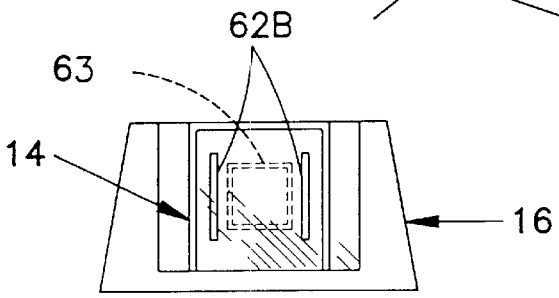
FIG. 4*b* depicts proper direct alignment of the front barrel sight behind the rear sight of the third embodiment of the instant invention.

In a second preferred embodiment of the instant invention, as seen in FIGS. 4*a* and 4*b*, the front transparent medium 60 of the front barrel sight 14 and the rear transparent medium 56 of the rear sight 16 possess distinct geometric shapes as the distinguishing indicia 62, but said shapes comprise a series of bars 62B upon the rear transparent medium 56 and a rectangle 63 upon the front transparent medium 60. Accordingly, proper alignment appears as seen in FIG. 4*b*.

Figure 5A:
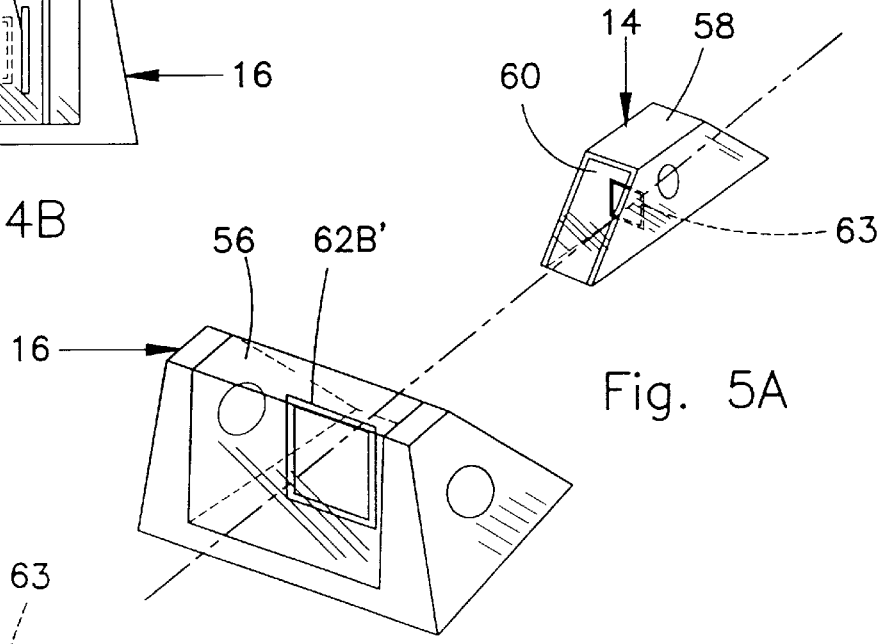
FIG. 5*a* illustrates a line of sight through a fourth embodiment of the gun sight system.
Figure 5B:
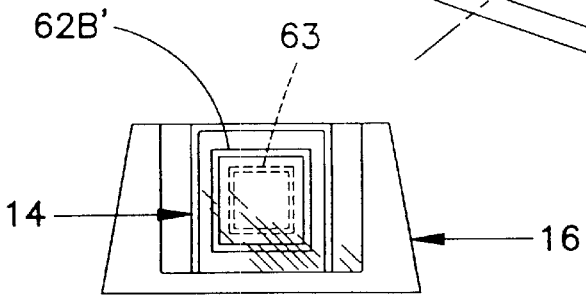
FIG. 5*b* depicts proper direct alignment of the front barrel sight behind the rear sight of the fourth embodiment of the instant invention.

In a third preferred embodiment of the instant invention, as seen in FIGS. 5*a* and 5*b*, a square 62B' of a size which differs from the rectangle 63 of the front transparent medium 60 is substituted in the rear transparent medium 56 of the rear sight 16, so that the sights upon alignment appear as seen in FIG. 5*b*. It should be understood that since the transparent mediums 56 and 60 are removable, the gun sighting system 50 may be varied by simply replacing said transparent mediums without removing the front barrel sight 14 or rear sight 16.

In a fourth and final embodiment of the instant invention, seen in FIGS. 3*a* and 3*b*, the front transparent medium 60 of the front barrel sight 14 possesses indicia 62 such as the geometric shapes discussed in the first three embodiments (i.e. a circle 62C or 62C'). The rear transparent medium 56 of the rear sight 16, however, lacks indicia 62 inscribed thereupon. Instead, one of the plurality of side walls 54 of the base assembly 52 of the rear sight 16 comprises a crown 64 having a peak 66. To properly aim the firearm 10, the front barrel sight 14 and rear sight 16 are aligned so that the peak 66 of the rear sight 16 appears to contact the center of the geometric shape indicia 62 located upon the front transparent medium 60 of the front barrel sight 14, as depicted in FIG. 3b. In FIG. 3*b* a circle 62C' is shown, but it is contemplated that any geometric shape may be employed.

What is claimed is:

1. A gun sight for installation upon a firearm to assist an operator firing bullets from said firearm to direct said bullets accurately at a target, the firearm comprising a slide-barrel assembly having a proximal end and a distal end, the gun sight system comprising:

a) a rear sight, installed at the proximal end of the slide-barrel assembly, the rear sight comprising a base assembly having a plurality of side walls;

b) a rear transparent medium, removeably secured between the plurality of side walls of the rear sight;

c) a front barrel sight, installed at the distal end of the slide-barrel assembly, the front barrel sight comprising a tent shaped housing;

d) a front transparent medium, removeably encapsulated within the tent-shaped housing of the front barrel sight; and e) indicia comprising a geometric shape inscribed on the front transparent medium and an equivalent but differing sized geometric shape on the rear transparent medium, said geometric shape selected from the group consisting of a square and a circle, wherein by orienting the firearm towards the target such that the larger of the geometric shapes appears to surround the smaller of said shapes with the target located in the center thereof when the operator views through the rear sight towards the front barrel sight, the firearm will be precisely aimed at the target and readied to fire a bullet directly thereat.

2. A gun sight system for installation upon a firearm to assist an operator firing bullets from said firearm to direct said bullets accurately at a target, the firearm comprising a slide-barrel assembly having a proximal end and a distal end, the gun sight system comprising:

a) a rear sight, installed at the proximal end of the slide-barrel assembly, the rear sight comprising a base assembly having a plurality of side walls, one of the plurality of side walls comprising a crown having a peak;

b) a rear transparent medium, removeably secured between the plurality of side walls of the rear sight;

c) a front barrel sight, installed at the distal end of the slide-barrel assembly, the front barrel sight comprising a tent shaped housing;

d) a front transparent medium, removeably encapsulated within the tent-shaped housing of the front barrel sight; and e) indicia inscribed upon the front transparent medium, such that by orienting the firearm towards the target such that the peak of the crown of the rear sight appears to point at the indicia inscribed upon the front transparent medium with the target located in the center thereof when the operator views through the rear sight towards the front barrel sight, the firearm will be precisely aimed at the target and readied to fire a bullet directly threat.

3. The gun sight system of claim 2, wherein the indicia inscribed upon the front transparent medium of the front sight comprises a circle.

4. The gun sight system of claim 2, wherein the indicia inscribed upon the front transparent medium of the front sight comprises a rectangle.

* * * * *